US011155395B2

(12) United States Patent
Knappe et al.

(10) Patent No.: US 11,155,395 B2
(45) Date of Patent: Oct. 26, 2021

(54) PRESSURE RELIEF VALVE WITH FLOATING DIAPHRAGM

(71) Applicant: SYNTEGON TECHNOLOGY GMBH, Waiblingen (DE)

(72) Inventors: Peter Knappe, Stuttgart (DE); Herbert Stotkiewitz, Bietigheim-Bissingen (DE); Jenny Haase, Allmersbach (DE)

(73) Assignee: SYNTEGON TECHNOLOGY GMBH, Waiblingen (DE)

( * ) Notice: Subject to any disclaimer, the term of this patent is extended or adjusted under 35 U.S.C. 154(b) by 0 days.

(21) Appl. No.: 16/580,097

(22) Filed: Sep. 24, 2019

(65) Prior Publication Data

US 2020/0239214 A1 Jul. 30, 2020

(30) Foreign Application Priority Data

Jan. 24, 2019 (DE) ..... 102019200860.7

(51) Int. Cl.
*B65D 77/22* (2006.01)

(52) U.S. Cl.
CPC ..... *B65D 77/225* (2013.01)

(58) Field of Classification Search
CPC ..... Y10T 137/4358; Y10T 137/4621; F16K 15/147; F16K 15/141; B65D 77/225
See application file for complete search history.

(56) References Cited

U.S. PATENT DOCUMENTS 1,251,758 A * 1/1918 Dayton ..... F16K 15/20 137/223
7,721,752 B2 * 5/2010 Stotkiewitz ..... B65D 77/225 137/246
8,342,203 B2 * 1/2013 Weaver ..... B65D 77/225 137/533.17
2009/0026199 A1 * 1/2009 Jeor ..... B65D 77/225 220/89.1
2012/0048853 A1 3/2012 Stadel et al.
2012/0243807 A1 * 9/2012 Pascoe ..... B65D 77/225 383/103

FOREIGN PATENT DOCUMENTS

EP 2396244 6/2013
WO WO-2017148754 A1 * 9/2017 ..... F16K 15/141

OTHER PUBLICATIONS

Machine translation of WO2017148754A1 (Year: 2017).*

* cited by examiner

*Primary Examiner* — Michael R Reid
(74) *Attorney, Agent, or Firm* — Michael Best & Friedrich LLP

(57) ABSTRACT

Pressure relief valve of a packaging container, comprising: a main body (2) with an edge region (3) and with a sealing face (4), wherein the edge region (3) is connectable in sealing fashion to a wall (10) of a packaging container (100) and wherein at least one passage opening (51) is formed in the sealing face (4), said passage opening extending through the main body (2), a first diaphragm (6) that is arranged over the passage opening (51) and at least partly covers the sealing face (4), a second diaphragm (7) that at least partly covers the first diaphragm (6), and a fluid (8) that is applied to the sealing face (4) and by means of which fluid the first diaphragm (6) is held on the sealing face (4) in floating fashion.

16 Claims, 2 Drawing Sheets

PRESSURE RELIEF VALVE WITH FLOATING DIAPHRAGM

BACKGROUND OF THE INVENTION

The present invention relates to a pressure relief valve of a packaging container, and to a packaging container.

The use of pressure relief valves in packaging containers that are used for packaging a filling material is known. Gases arising within the packaging can be vented from the packaging container through the pressure relief valve. The necessity of such an option for gas venting from the packaging container arises, for example, in the case of a filling material that still outgases, even after packaging, and hence may produce positive pressure in the packaging container. However, an inlet of air, more particularly of the oxygen contained in the air, should often be avoided at the same time in order to maintain a quality of the filling material. A pressure relief valve used to this end is shown in EP 2 396 244 B1, for example.

SUMMARY OF THE INVENTION

In relation thereto, the pressure relief valve according to the invention of a packaging container offers the advantage of an improved sealing of the packaging container and of an improved opening behavior. Here, a change between open and closed state of the pressure relief valve, in particular, is optimized. The pressure relief valve according to the invention closes earlier following an equalization of pressures within and outside of the packaging container, i.e., after a positive pressure in the packaging container has been removed by the outflow of gas from the packaging container into the surroundings. Moreover, an ingress of air into the packaging container is prevented in more reliable fashion. According to the invention, this is achieved by virtue of the pressure relief valve comprising a main body with an edge region and with a sealing face, wherein the sealing face surrounds at least one passage opening that extends through the main body. Preferably, the passage opening is formed in the sealing face. Here, the edge region is connectable in sealing fashion to a wall of the packaging container. Advantageously, the edge region, which surrounds the sealing face in ring-shaped fashion in particular, is connectable to an inner side of the wall of the packaging container such that the pressure relief valve is arranged in the interior of the packaging container. Here, the connection between edge region and wall can be established in many different ways. By way of example, the pressure relief valve at the edge region can be sealed to the wall of the packaging container by means of an ultrasonic bond. As an alternative, an adhesive connection would also be possible.

Furthermore, the pressure relief valve comprises a first diaphragm that is arranged over the passage opening and at least partly covers the sealing face. Moreover, the pressure relief valve comprises a second diaphragm that at least partly covers the first diaphragm. Further, provision is made of a fluid that is arranged on the sealing face such that the fluid is arranged between the sealing face and the first diaphragm. By means of the fluid, the first diaphragm is held in floating fashion on the sealing face and, in particular, the second diaphragm is also held in floating fashion on the first diaphragm. Here, preferably, a silicone oil or a similar fluid, which is suitable as a sealing liquid, is provided as fluid. Consequently, the fluid brings about lateral mobility of the first diaphragm and of the second diaphragm on the sealing face and within the edge region.

Here, the sealing effect of the pressure relief valve is obtained by the interaction of sealing face, first diaphragm, second diaphragm and fluid. The fluid brings about an adhesion, as a result of which the first diaphragm adheres to the sealing face and consequently brings about the sealing of the passage opening. Furthermore, the capillary effect ensures that the fluid is distributed uniformly between sealing face and first diaphragm. Since the passage opening moreover has a very small cross section, preferably in the region of a few tenths of a millimeter, more particularly less than 0.5 mm, the capillary effect moreover prevents an outflow of the fluid through the passage opening.

Provided there is positive pressure in the packaging container in relation to the surroundings, for example caused by outgassing of a packaged filling material, a gas channel forms in the fluid, said gas channel extending through the fluid from the passage opening and slightly lifting the first diaphragm. The gas can flow out into the surroundings through said gas channel, as a result of which pressure equalization is brought about. As soon as the pressure difference between the packaging container and surroundings drops below a certain value again, the first diaphragm is pulled back in the direction of the sealing face by the adhesive force of the fluid and the gas channel is closed such that the pressure relief valve is closed again in sealing fashion.

A particularly good sealing effect and an optimized response of the pressure relief valve when opening and closing is obtained as a result of the pressure relief valve according to the invention comprising a plurality of diaphragms. Here, the floating arrangement of the first diaphragm has a particularly expedient effect on a response of the pressure relief valve to pressure changes. The second diaphragm has a further expedient effect on the sealing effect and ensures a particularly low oxygen diffusion through the pressure relief valve. In particular, the first diaphragm and the second diaphragm are formed from a flexible material. This interaction between first diaphragm and second diaphragm is particularly advantageous since, as result of the arrangement according to the invention in the pressure relief valve, the first diaphragm and the second diaphragm also have a certain mobility relative to one another. Moreover, the first diaphragm and the second diaphragm may have different dimensions, for example in respect of their thicknesses. As a result, the first diaphragm and the second diaphragm can each be optimally adapted for different use purposes to the corresponding requirements in view of the opening and closing behavior at different pressure differences over the pressure relief valve. The dependent claims have as content preferred developments of the invention.

Preferably, the fluid is arranged, completely in each case, between the first diaphragm and the sealing face and between the first diaphragm and the second diaphragm. Here, the fluid is uniformly distributed between these elements as a result of the capillary effect. As a result, a particularly expedient floating arrangement of the first diaphragm sets in, having a particularly advantageous effect on the sealing effect of the pressure relief valve. Here, the fluid brings about both an adhesion between first diaphragm and sealing face and also between first diaphragm and second diaphragm.

Particularly expediently, a first external dimension of the first diaphragm is less than or equal to a second external dimension of the second diaphragm. Here, the first external dimension and the second external dimension are each considered in a plane parallel to the sealing face. Preferably, the first external dimension is between 5% and 10% smaller than the second external dimension. Particularly expediently, the two diaphragms each have circular cross sections in the plane parallel to the sealing face, as a result of which the first external dimension is a first diameter and the second external dimension is a second diameter. Such a design of the first diaphragm with the same or smaller first external dimension in comparison with the second diaphragm promotes a uniform distribution of the fluid, in each case between the two diaphragms and between the first diaphragm and the sealing face, as a result of the capillary effect. This at the same time promotes the adhesive force, which the fluid causes between the sealing face and the first diaphragm and between the first diaphragm and the second diaphragm, as a result of which, consequently, a particularly good sealing effect of the pressure relief valve is obtained.

Particularly preferably, the first external dimension of the first diaphragm and a position of the at least one passage opening in the sealing face are matched to one another in such a way that the first diaphragm completely covers the at least one passage opening. Here, the passage opening remains covered by the first diaphragm, even in the case of a maximum lateral displacement of the first diaphragm on the sealing face and within the main body. Provided a plurality of passage openings are formed in the sealing face, each of these passage openings is always covered by the first diaphragm. That is to say, a minimum first external dimension and/or the positions of the passage openings are chosen in such a way that the passage openings still remain covered by the first diaphragm, even in the case of a maximum lateral displacement of the latter. Here, the maximum lateral displacement means that the first diaphragm is displaced so far on the sealing face that the first diaphragm contacts the edge region. This ensures a secure and reliable function of the pressure relief valve at all times.

Furthermore, a thickness ratio of a first thickness of the first diaphragm to a second thickness of the second diaphragm is advantageously between 1:1 and 1:10. Preferably, the thickness ratio is between 1:2 and 1:6. Particularly preferably, the thickness ratio is 1:4, i.e., the second diaphragm is advantageously four times as thick as the first diaphragm. Consequently, the first diaphragm can have a particularly flexible design in order to already ensure a sensitive response of the pressure relief valve at low positive pressures. Moreover, the second diaphragm can have a more rigid embodiment in order to guarantee a good seal in relation to the surroundings and sufficient stability of the arrangement, and consequently ensure the functional reliability of the pressure relief valve.

Preferably, a ratio of a fluid volume of the fluid to an internal volume of the main body is at least 3:100. Preferably, this ratio is at least equal to 5:100 and, particularly preferably, no more than 3:10. Here, the internal volume of the main body is considered to be the entire volume enclosed by the main body. In the case where the edge region of the main body is sealed to the inner side of the wall of the packaging container, the internal volume is delimited by the sealing face, edge region and inner side of the wall. This ensures that an optimal fluid volume is available in relation to the main body, which, on account of the adhesive forces, ultimately bears the main responsibility for the adhesion of the first diaphragm on the sealing face and consequently for the sealing effect of the pressure relief valve.

Furthermore, two passage openings are advantageously formed in the main body. Here, the two passage openings are arranged in off-centered and symmetric fashion with respect to one another with respect to a central axis of the main body. As a result, the opening and closing behavior of the pressure relief valve can be further improved. As a result of the off-centered arrangement of the passage openings, these lie closer to the edges of the diaphragms. Consequently, the outflowing gas must cover a shorter path through the fluid when equalizing positive pressure in the packaging container. Consequently, the resistance to the valve being opened is even smaller. Moreover, the resealing is also improved since only a smaller part of the first diaphragm, specifically predominantly the corresponding edge regions of the first diaphragm radially outside of the passage openings, is deformed and lifted off the sealing face in the case of an open pressure relief valve. Consequently, it is also only this region that has to be deformed back again in order to ensure a secure seal again.

Particularly preferably, the first diaphragm and the second diaphragm are each embodied as a circular film disk. That is to say, the first diaphragm and the second diaphragm each have a circular cross section, with these being embodied to be very thin in each case in order to have a film-like character. Particularly expediently, the first diaphragm and the second diaphragm are each formed from a plastic. As a result, the two diaphragms can be produced in particularly simple and cost-effective fashion.

Preferably, the first diaphragm has greater flexibility than the second diaphragm. As a result, the first diaphragm is more easily deformable and, for example, portions of the first diaphragm can be lifted more easily from the sealing face for the purposes of forming the gas channel. Here, the second diaphragm can have a more rigid embodiment than the first diaphragm in order to exert a certain restoring force on the first diaphragm, as a result of which the pressure relief valve closes again in a particularly fast and reliable manner following a pressure equalization between packaging container and surroundings.

Furthermore, the main body advantageously has a round cross-sectional form. In particular, the sealing face has a circular cross section in this case. Consequently, the pressure relief valve can be produced in simple and cost-effective fashion and a uniform distribution of the fluid by the capillary effect is promoted.

Preferably, the pressure relief valve further comprises at least one third diaphragm. Here, the third diaphragm is arranged between the first diaphragm and the second diaphragm. As a result, the mobility of the diaphragm arrangement can be further increased in order to further optimize the opening and closing behavior of the pressure relief valve.

Preferably, the main body is an injection-molded part. Particularly preferably, the main body is formed from plastics. Consequently, the main body can be produced particularly easily and cost-effectively, wherein the geometry of the main body can be designed in simple and flexible fashion.

Further, the invention relates to a packaging container that comprises at least one pressure relief valve according to the invention. By way of example, the packaging container can be used to package foodstuff. Particularly expediently, the packaging container is an aroma protective packaging for coffee. As a result of the packaging container with the pressure relief valve according to the invention, products, such as coffee, for example, can be packaged in airtight fashion, wherein a positive pressure arising in the interior of the packaging container as a result of outgassing of the products can be reliably equalized by means of the pressure relief valve. Here, an ingress of oxygen, in particular, into the closed packaging container is also reliably prevented by the pressure relief valve.

BRIEF DESCRIPTION OF THE DRAWINGS

Below, the invention is described on the basis of exemplary embodiments in conjunction with the figures. In the figures, functionally equivalent components are denoted by the same reference sign in each case. Here.

DETAILED DESCRIPTION

Figure 1:
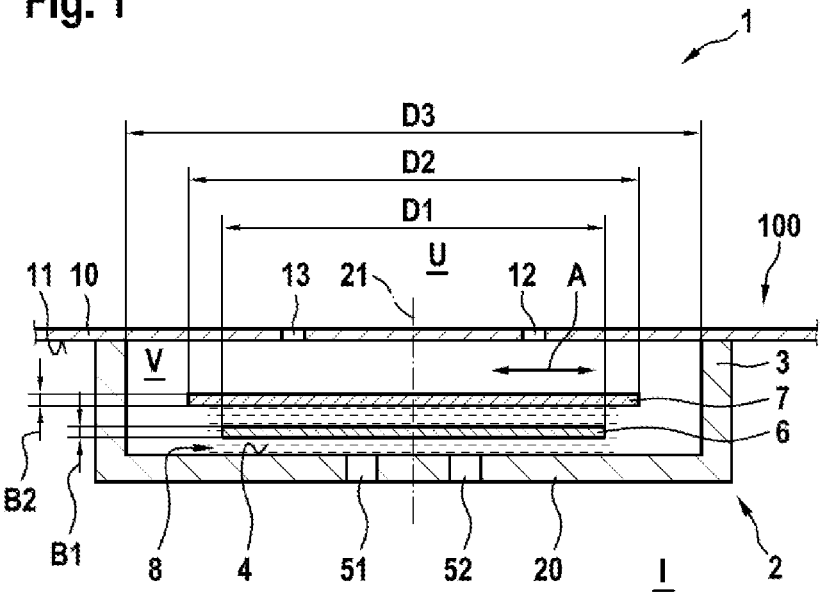
FIG. 1 shows a simplified schematic sectional view of a pressure relief valve according to a first exemplary embodiment of the invention.

FIG. 1 shows a simplified schematic sectional view of a pressure relief valve 1 according to a first exemplary embodiment of the invention. The pressure relief valve 1 is connected to a wall 10 of a closed packaging container 100, with only a small section of this wall 10 being illustrated. Here, the pressure relief valve 1 is fastened to a side 11 of the wall 10 facing an interior I of the packaging container 100.

The packaging container 100 can be used to package filling materials, such as foodstuff of very different types. By way of example, such a packaging container 100 is suitable as an aroma protective packaging for coffee. What the pressure relief valve 1 according to the invention achieves is that the gases from the interior I of the packaging container 100 can escape to the surroundings U while, in the reverse direction, an ingress of air into the interior I of the packaging container 100 is prevented by the pressure relief valve 1. Such sealing of the packaging container 100 while simultaneously providing the option of equalizing positive pressure is particularly advantageously possible by way of the pressure relief valve 1.

In order to allow gases to escape into the surroundings U from the interior I of the packaging container 100, two holes 12, 13 are formed in the wall 10 of the packaging container 100 in this case, said holes each extending through the wall 10.

The pressure relief valve 1 comprises a main body 2, a first diaphragm 6 and a second diaphragm 7. Here, the main body 2 has a pot-shaped embodiment that is substantially concentric with a central axis 21.

The main body 2 has a disk-shaped sealing region 20, which is adjoined by a ring-shaped edge region 3. At an end lying opposite the sealing region 20, the edge region 3 is connected to the wall 10 of the packaging container 100. The connection between edge region 3 and wall 10 is an ultrasonic bond. Consequently, an interior volume V of the main body 2 is enclosed by the main body 2 and wall 10 of the packaging container 100.

A surface of the sealing region 20 facing the interior volume V forms a sealing face 4 of the pressure relief valve 1. Here, the sealing face 4 is a planar face. Two passage openings 51, 52 are formed in the sealing face 4, said passage openings each extending through the sealing region 20 of the main body 2. Here, the two passage openings 51, 52 are embodied in off-centered and symmetric fashion with respect to the central axis 21 of the main body 2, as is also evident from FIG. 2.

The first diaphragm 6 is arranged on the main body 2 in such a way that said diaphragm partly covers the sealing face 4. Here, the first diaphragm 6 is arranged over the two passage openings 51, 52 and covers the latter. The second diaphragm 7 is arranged in such a way that it covers the first diaphragm 6.

Further, a fluid 8, a silicone oil in this case, is applied to the sealing face 4. The fluid 8 is also arranged between the first diaphragm 6 and the second diaphragm 7. By means of the fluid 8, the first diaphragm 6 and the second diaphragm 7 are held in floating fashion on the sealing face 4 in order to bring about the sealing effect of the pressure relief valve 1. As a result of the capillary effect, the fluid 8 is uniformly distributed between the first diaphragm 6 and the second diaphragm 7. Here, as a result of adhesion between the sealing face 4 and first diaphragm 6, the fluid 8 ensures that the first diaphragm 6 is held on the sealing face 4 by means of an adhesive force and the sealing is brought about thereby, i.e., an ingress of air from the surroundings U into the interior I of the packaging container 100 is prevented.

Moreover, the fluid 8 brings about a floating arrangement of the two diaphragms 6, 7 on the sealing face 4. That is to say, the first diaphragm 6 and the second diaphragm 7 are arranged on the sealing face 4 in a manner movable in relation to the central axis 21 in the lateral direction A. Consequently, the two diaphragms 6, 7 form a movable sealing arrangement together with the fluid 8, said sealing arrangement facilitating a quick and reliable response when changing between opening and closing of the pressure relief valve 1.

If positive pressure arises in the interior I of the packaging container 100 on account of outgassing of packaged products, gas can be vented to the outside, to the surroundings U, through the pressure relief valve 1. To this end, a gas channel forms in the pressure relief valve 1, said gas channel extending through the fluid 8 from one or both of the passage openings, and, at its edge, the first diaphragm 6 slightly lifts from the sealing face 4 in the process. Gas can be vented to the surroundings U through this gas channel and through the holes 12, 13, as a result of which pressure equalization is brought about.

As soon as the pressure has been sufficiently equalized, the gas channel is closed again by the fluid 8 and the first diaphragm 6 is pulled back in the direction of the sealing face 4 by the adhesive force of the fluid 8 such that the pressure relief valve 1 is sealed again. The second diaphragm 7 additionally supports this resealing process. In particular, the second diaphragm 7 causes a certain amount of pretension, which promotes a return of the first diaphragm 6 back into its initial position. Moreover, the capillary effect in this case causes the fluid 8 to be distributed uniformly around the first diaphragm 6, i.e., further promotes the first diaphragm 6 deforming back into its initial form.

Figure 2:
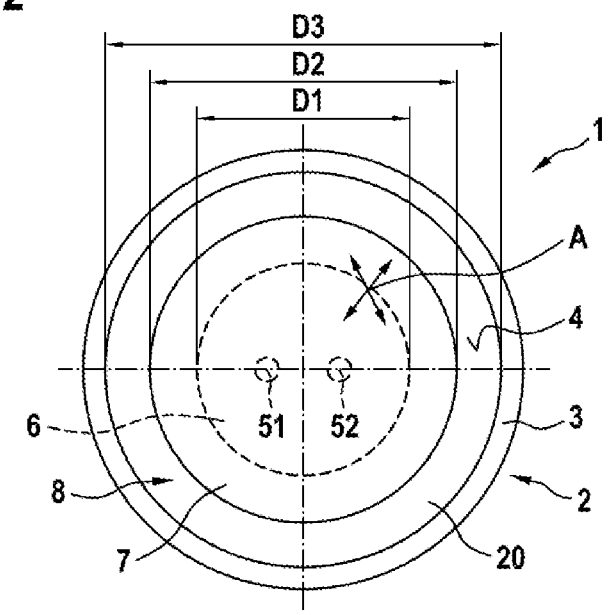
FIG. 2 shows a plan view of the pressure relief valve of FIG. 1.

Furthermore, the first diaphragm 6 and the second diaphragm 7 are each formed as circular film disks, as is also evident from FIG. 2 in particular. Here, FIG. 2 shows a plan view of the pressure relief valve 1 of FIG. 1, with the packaging container not being illustrated. As is evident from FIG. 2, the first diaphragm 6, the second diaphragm 7 and the main body 2 are each formed with a circular cross section and are arranged concentrically with respect to one another in the non-displaced state illustrated here.

A first diameter D1 of the first diaphragm 6 is 5% smaller than a second diameter D2 of the second diaphragm 7. Moreover, the second diameter D2 is 10% smaller than an internal diameter D3 of the edge region 3 of the main body 2. The internal diameter D3 consequently also corresponds to an external diameter of the sealing face 4. As a result of the first diameter D1 that is smaller in comparison with the second diameter D2, the fluid 8 can be distributed uniformly between the first diaphragm 6 and the second diaphragm 7 in particularly simple fashion on account of the capillary effect since the fluid 8 can easily flow around an edge of the first diaphragm 6. Furthermore, the first diaphragm 6 has a first thickness B1, which equals a second thickness B2 of the second diaphragm 7.

For an optimal function of the pressure relief valve 1, the first diameter D1 and the positions of the two passage openings 51, 52 are matched to one another in such a way that the first diaphragm 6 still completely covers both passage openings 51, 52, even in the case of a maximum lateral displacement on the sealing face 4. That is to say, even if the first diaphragm 6 is displaced so far in the lateral direction A that said diaphragm abuts against the edge region 3, each of the passage openings 51, 52 still is completely covered by the first diaphragm 6.

A fluid volume of the fluid 8 has a ratio of 3:100 to the internal volume V of the main body 2. This ensures that a sufficient fluid volume is available in order to finally obtain the adhesion of the first diaphragm 6 on the sealing face 4 and consequently obtain the adhesion for the sealing effect by means of the adhesive force. Moreover, this ratio also ensures that no excess fluid volume is present, which could have a negative effect on a targeted, reliable adhesion of the first diaphragm 6 on the sealing face 4 and of the second diaphragm 7 on the first diaphragm 6.

Figure 3:
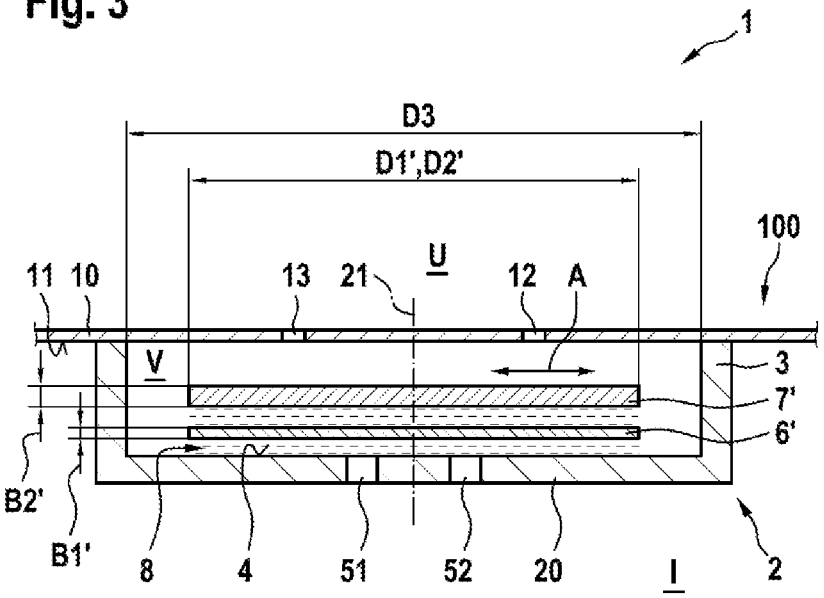
FIG. 3 shows a simplified schematic sectional view of a pressure relief valve according to a second exemplary embodiment of the invention.

FIG. 3 shows a simplified schematic sectional view of a pressure relief valve 1 according to a second exemplary embodiment of the invention. Here, the second exemplary embodiment substantially corresponds to the first exemplary embodiment in FIGS. 1 and 2, with the two diaphragms 6', 7' having different proportions relative to one another.

In the second exemplary embodiment in FIG. 3, the first diameter D1' of the first diaphragm 6' and the second diameter D2' of the second diaphragm 7' are identical. Furthermore, the second thickness B2' of the second diaphragm 7' in the second exemplary embodiment is four times as large as the first thickness B1' of the first diaphragm 6'. Expressed differently, a thickness ratio of the first diaphragm 6' to the second diaphragm 7' of 1:4 is present. As a result, the second diaphragm 7' is significantly more rigid than the first diaphragm 6' and a more stable arrangement of the two diaphragms 6', 7' can be achieved. What can be achieved as a result thereof is that the pressure relief valve 1 opens later, i.e., in the case of a higher positive pressure in the interior I in relation to the surroundings U, in comparison with the first exemplary embodiment since a much larger resistance must be overcome before the first diaphragm 6' lifts off the sealing face 4. Moreover, the pressure relief valve 1 closes even quicker since the second diaphragm 7' brings about a greater restoration force.

Figure 4:
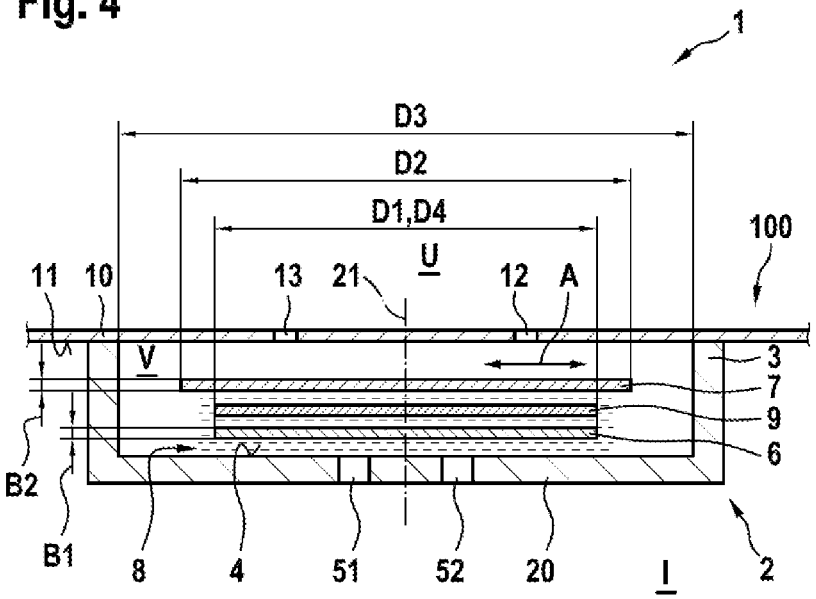
FIG. 4 shows a simplified schematic sectional view of a pressure relief valve according to a third exemplary embodiment of the invention.

FIG. 4 shows a simplified schematic sectional illustration of a pressure relief valve 1 according to a third exemplary embodiment of the invention. Here, the third exemplary embodiment substantially corresponds to the first exemplary embodiment in FIGS. 1 and 2, with a third diaphragm 9 additionally being provided, said third diaphragm being arranged between the first diaphragm 6 and the second diaphragm 7. The third diaphragm 9 has a third diameter D4, which equals the first diameter D1 of the first diaphragm 6. As a result of the capillary effect, the fluid 8 is uniformly distributed between all three diaphragms 6, 7, 9 and between the first diaphragm 6 and the sealing face 4. Here, the third diaphragm 9 further promotes the mobility of the floating diaphragm arrangement and consequently ensures a further optimized sealing effect of the pressure release valve 1, particularly in view of opening and closing for the purposes of, or following, the equalization of a positive pressure in the interior I of the packaging container 100.

The invention claimed is:

1. A pressure relief valve for a packaging container, the pressure relief valve comprising:

a main body (2) with an edge region (3) and with a sealing face (4), wherein the edge region (3) is configured to be connected in sealing fashion to a wall (10) of the packaging container (100) and wherein the sealing face (4) surrounds at least one passage opening (51) that extends through the main body (2), a first diaphragm (6) that is arranged over the passage opening (51) and at least partly covers the sealing face (4), a second diaphragm (7) that at least partly covers the first diaphragm (6), and a fluid (8) that is applied to the sealing face (4), wherein the fluid (8) is arranged between the sealing face and the first diaphragm (6), wherein the fluid (8) brings about lateral mobility of the first diaphragm (6) and of the second diaphragm (7) with respect to the sealing face (4) and within the edge region (3), wherein the fluid (8) is arranged, completely in each case, between the first diaphragm (6) and the sealing face (4) and between the first diaphragm (6) and the second diaphragm (7).

2. The pressure relief valve according to claim 1, wherein the first diaphragm (6) has a first external dimension (D1) in a plane parallel to the sealing face (4), wherein the second diaphragm (7) has a second external dimension (D2) in a plane parallel to the sealing face (4) and wherein the first external dimension (D1) is less than or equal to the second external dimension (D2).

3. The pressure relief valve according to claim 2, wherein the first external dimension (D1) and a position of the at least one passage opening (51) on the sealing face (4) are matched to one another in such a way that the first diaphragm (6) completely covers the at least one passage opening (51) in the case of any lateral displacement of the first diaphragm (6) on the sealing face (4).

4. The pressure relief valve according to claim 1, wherein a ratio of a fluid volume of the fluid to an internal volume (V) of the main body (2) is at least 3:100.

5. The pressure relief valve according to claim 1, wherein two passage openings (51, 52) are formed in the main body (2) and wherein the two passage openings (51, 52) are arranged in off-centered and symmetric fashion with respect to a central axis (21) of the main body (2).

6. The pressure relief valve according to claim 1, wherein the first diaphragm (6) and the second diaphragm (7) are each embodied as a circular film disk.

7. The pressure relief valve according to claim 1, wherein the first diaphragm (6) has greater flexibility than the second diaphragm (7).

8. The pressure relief valve according to claim 1, wherein the main body (2) has a round cross-sectional form.

9. The pressure relief valve according to claim 1, wherein the main body (2) is an injection-molded part.

10. The pressure relief valve according to claim 1, wherein a ratio of a fluid volume of the fluid to an internal volume (V) of the main body (2) is at least 5:100.

11. The pressure relief valve according to claim 1, wherein a ratio of a fluid volume of the fluid to an internal volume (V) of the main body (2) is no more than 3:10.

12. The pressure relief valve according to claim 1, wherein the main body (2) is an injection-molded part and is formed from plastics.

13. A packaging container comprising at least one pressure relief valve (1) according to claim 1.

14. The pressure relief valve according to claim 1, wherein the fluid (8) is a liquid.

15. The pressure relief valve according to claim 1, wherein the second diaphragm (7) is formed of plastic.

16. The pressure relief valve according to claim 1, wherein the first diaphragm (6) is held in floating fashion on the sealing face (4) and the second diaphragm (7) is held in floating fashion on the first diaphragm (6).

* * * * *